US005752651A

United States Patent [19]

Correll

[11] Patent Number: 5,752,651

[45] Date of Patent: May 19, 1998

[54] MATABLE BLANK AND FOOD CARTON

[76] Inventor: John D. Correll, 8459 Holly Dr., Canton, Mich. 48187

[21] Appl. No.: 697,502

[22] Filed: Aug. 26, 1996

Related U.S. Application Data

[63] Continuation-in-part of Ser. No. 289,306, Aug. 11, 1994, Pat. No. 5,553,771.

[51] Int. Cl.[6] ..... B65D 5/20

[52] U.S. Cl. ..... 229/150; 229/128; 229/190; 229/935

[58] Field of Search ..... 229/128, 149, 229/148, 150, 160, 190, 933, 935, 936

[56] References Cited

U.S. PATENT DOCUMENTS

| | | | |
|---|---|---|---|
| 1,634,596 | 7/1927 | Schurmann . | |
| 2,048,729 | 7/1936 | Daller . | |
| 2,072,753 | 3/1937 | Ikeda et al. . | |
| 2,544,565 | 3/1951 | Phillips | 229/190 |
| 2,756,919 | 7/1956 | Davidson . | |
| 3,003,674 | 10/1961 | Ringler . | |
| 3,064,877 | 11/1962 | Forrer et al. | 229/150 |
| 3,166,230 | 1/1965 | Engstrom | 229/149 |
| 3,543,995 | 12/1970 | Delma | 229/149 |
| 3,572,576 | 3/1971 | Foster . | |
| 3,658,237 | 4/1972 | Engel | 229/190 |
| 3,744,705 | 7/1973 | Kuhn et al. | 229/148 |
| 4,265,393 | 5/1981 | Orchard . | |
| 4,765,534 | 8/1988 | Zion et al. | 229/109 |
| 4,804,136 | 2/1989 | Hall | 229/112 |
| 5,118,032 | 6/1992 | Geho | 229/110 |
| 5,121,876 | 6/1992 | Johnson | 229/149 |
| 5,305,951 | 4/1994 | Kuhn et al. | 229/105 |
| 5,337,951 | 8/1994 | Roccaforte | 229/186 |
| 5,553,771 | 9/1996 | Correll | 229/933 |

FOREIGN PATENT DOCUMENTS 2385541 10/1978 France .

OTHER PUBLICATIONS

Photo I: A Blank of B–Flute Pizza Box Used by a Pizza Company –Photographer J. Corroll –Aug. 1996.

*Primary Examiner*—Gary E. Elkins

[57] ABSTRACT

An easily-folded E-flute corrugated carton for pizza, breadsticks, donuts, and the like. The carton is formed from a matable, alignable blank that reduces material consumption and cost. Key structural elements include (a) a front-edge-sloping cover with free side edges, (b) a rear wall with free ends, (c) parallel side walls each with a free rear end and free top edge, (d) inward-slope-creating corner flaps on front corners of the side walls, and (e) proportional bottom panel dimensions that allow the box to have acceptable load-carrying capacity, or box cavity volume.

25 Claims, 4 Drawing Sheets

MATABLE BLANK AND FOOD CARTON

CROSS-REFERENCES TO RELATED APPLICATIONS

This is a continuation-in-part of application Ser. No. 08/289,306, filed Aug. 11, 1994 U.S. Pat. No. 5,553,771.

FIELD OF THE INVENTION

This invention relates to cartons made of foldable material and, in particular, to cartons for relatively flat food products such as pizza, breadsticks, donuts, and the like.

DESCRIPTION OF THE PRIOR ART

In the food industry, the cost of the carton for delivery and carry-out products is a substantial part of the total cost of the product and, therefore, a concern of many companies. The main cost component of cartons is the material consumed in making the blank. To achieve a minimum amount of material consumption during manufacture of blanks, a blank should be matable, or capable of being manufactured with multiple blanks in inverted-and-nested configuration.

To achieve maximum material savings from a matable blank, the blank should (a) be alignable at the ends with adjacent blanks, (b) have the narrowest possible blank width, and (c) be matable or nestable to a maximum depth.

To achieve alignability in mating, it helps to have a free rear end on side walls of the carton. However, a free rear end on the side walls of a rectangular-shaped carton can result in the walls angling outward at the rear ends. This, in turn, can result in a sloppy-looking carton and the inability of the side walls to support any downward pressure on an overlying cover. It also precludes the use of thinner, less rigid E-flute corrugated board because such material has a greater tendency to bend and angle outward in long panels than does thicker, more rigid B-flute board. The prior art does not address these issues. So, there remains a problem of how to create a functional rectangular-shaped carton that maximizes material savings by having side walls with a free rear end, especially when using thin, space-saving E-flute board.

To obtain the narrowest possible blank width, it helps to have a free top edge on the side walls. However, a free top edge on long side walls can result in the walls bowing outward in the middle, especially when thin E-flute board is used. This, in turn, can result in a sloppy-looking carton and the inability of the side walls to support an overlying cover. One solution is to have full-depth cover side flaps that tuck inside the box. However, this eliminates the possibility of mating during manufacture. The prior art does not address these issues. So, there remains a problem of how to create a functional rectangular-shaped carton having side walls with a free top edge and a cover without side flaps.

To achieve maximum matable depth, it helps to have free side edges on the cover panel. However, free side edges on a cover panel can result in the sides of the cover warping upward, especially when the carton contains hot food and while being held under a heat lamp. The prior art does not address this issue. So, there remains a problem of how to create a box having a cover with free side edges and that lays on top of the side walls and resists warping upward during use.

The most similar prior art references to my invention are: Schurmann U.S. Pat. No. 1,634,596 granted on Jul. 5, 1927; Daller U.S. Pat. No. 2,048,729 granted on Jul. 28, 1936; Ikeda et al. U.S. Pat. No. 2,072,753 granted on Mar. 2, 1937; Davidson U.S. Pat. No. 2,756,919 granted on Jul. 31, 1956; Ringler U.S. Pat. No. 3,003,674 granted on Oct. 10, 1961; Foster U.S. Pat. No. 3,572,576 granted on Mar. 30, 1971; Orchard U.S. Pat. No. 4,265,393 granted on May 5, 1981; Zion et al. U.S. Pat. No. 4,765,534 granted on Aug. 23, 1988; Hall U.S. Pat. No. 4,804,136 granted on Feb. 14, 1989; Geho U.S. Pat. No. 5,118,032 granted on Jun. 2, 1992; Kuhn et al. U.S. Pat. No. 5,305,951 granted on Apr. 26, 1994; and Roccaforte U.S. Pat. No. 5,337,951 granted Aug. 16, 1994. In addition, there is a French patent 2,385,541 granted in October, 1978, and a square folder-style B-flute carton used by a pizza company that has a cover with free side edges.

While the above references each have something in common with the invention, none of them solve the previously-cited problems. By solving those problems, a matable carton of lower cost and enhanced functionality would be provided for the pizza and retail food industries.

In conclusion, it would be highly desirable to provide a carton that overcomes the above-described problems and disadvantages.

OBJECT AND ADVANTAGES

Accordingly, the object of my invention is an optimally functional carton, particularly a rectangular-shape carton that can be manufactured with E-flute board and in mated configuration with multiple blanks for maximum material savings. Structure of the invention that enables achievement of the object includes one or more of the following: (a) a cover panel with free side edges, (b) a rear wall with free ends, (c) parallel side walls each with a free rear end and a free top edge, (d) inward-slope-creating corner flap on a front end of each side wall to counteract the side walls sloping outward, (e) a front-edge-sloping cover to counteract the free side edges of the cover warping upward, and (f) a shortened box length and elongated box width (relative to one another) to provide a matable E-flute carton of the above structure with acceptable load-carrying capacity.

The advantages of my invention are a cost-effective, matable rectangular-shaped carton which can be made of E-flute board and which, nonetheless, has load-carrying capacity for an acceptable-sized portion of food and also functions well during use.

Further objects and advantages of the invention will become apparent from consideration of the following detailed description, related drawings, and appended claims.

SUMMARY OF THE INVENTION

In accordance with the invention, a carton is created that can incorporate one or more of the following features:

1) A matable, alignable blank structure comprising a cover with free side edges and an interlock means that interlocks with a front wall structure, a rear wall with free ends, parallel side walls each with a free rear end and free top edge;

2) An inward-slope-creating corner flap;

3) A front-edge-sloping cover;

4) A dimensional configuration (or bottom panel length and width) wherein the matable blank described in item 1 forms an optimally functional carton made of E-flute board that has adequate load-carrying capacity, or volume, in the box cavity.

A complete understanding of the invention can be obtained from the detailed description that follows.

LIST OF REFERENCE NUMERALS

Figure 1:
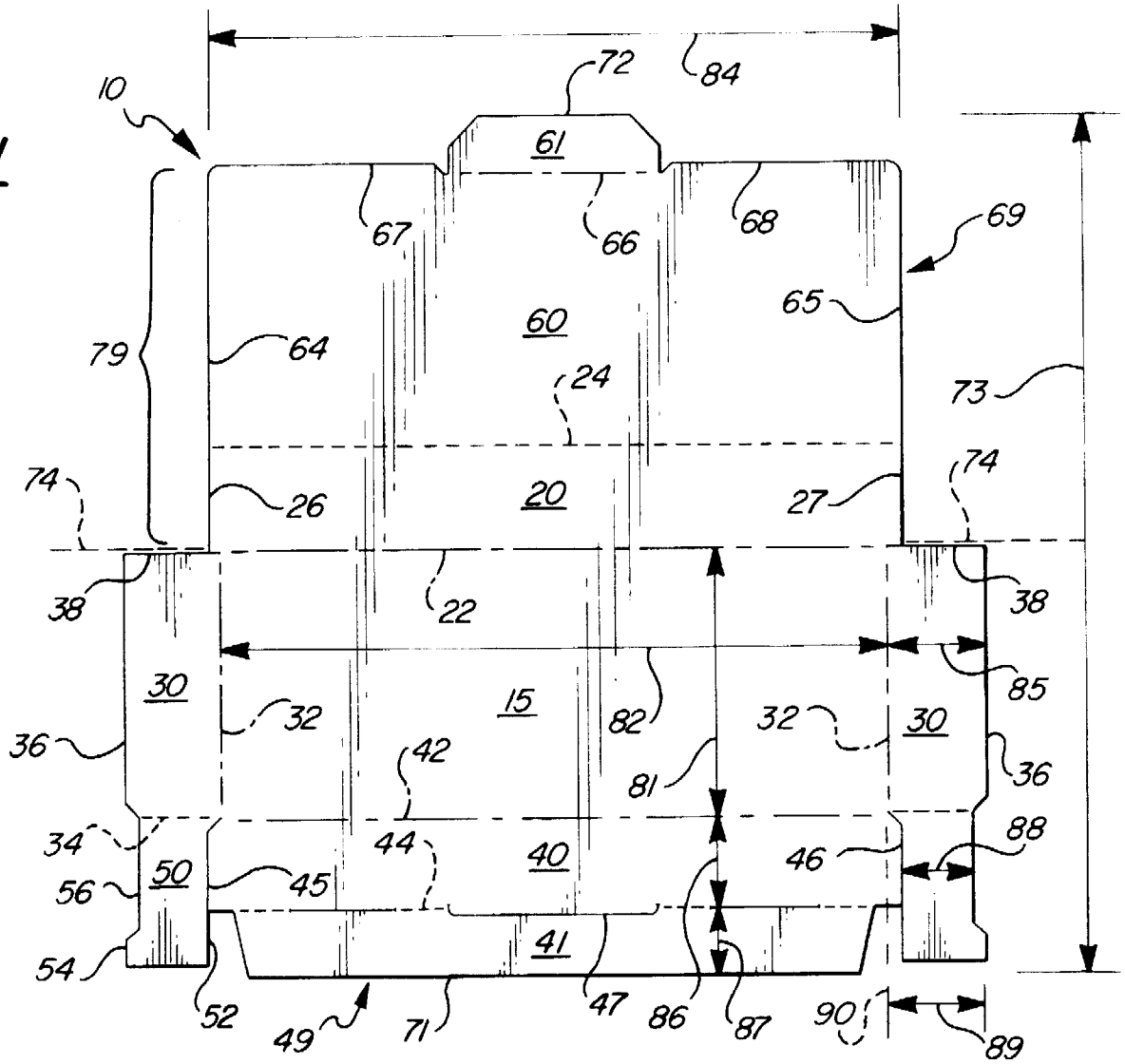
FIG. 1 is a plan view of a blank of the preferred embodiment of the invention.

Between drawings, like reference numerals designate corresponding parts.

10 blank of preferred embodiment
12 box of preferred embodiment
15 bottom panel
20 rear wall
22 rear wall fold line (and bottom edge)
24 top edge (and cover fold line)
26 free end
27 free end
30 side wall (one on each side)
32 side wall fold line (and bottom edge)
34 front end (and corner flap fold line)
**34*a*** corner flap fold line
**34*b*** corner flap fold line
**34*c*** corner flap fold line
35 secondary corner flap fold line
36 free top edge
38 free rear end
40 front wall
41 auxiliary panel
42 front wall fold line (and bottom edge)
44 auxiliary panel fold line (and top edge of front wall)
45 end of front wall
46 end of front wall
47 cover interlock means
49 front wall structure
50 inward-slope-creating corner flap
**50*a*** first alternate corner flap
**50*b*** second alternate corner flap
**50*c*** third alternate corner flap
52 bottom edge of flap
54 upper portion of top edge
56 lower portion of top edge
**57*a*** top edge
**57*b*** top edge
**57*c*** top edge
60 cover panel
61 front wall structure interlock means
64 free side edge
65 free side edge
66 middle section of front edge
67 lateral section of front edge
68 lateral section of front edge
69 cover
71 front end edge of blank
72 rear end edge of blank
73 length between front and rear end edges
74 imaginary midline
79 recess
81 bottom panel length
82 bottom panel width
84 cover panel width and rear wall width
85 side wall height
86 front wall height
87 auxiliary panel height
88 primary height of corner flap
89 secondary height of corner flap
90 bottom edge projection line
102 oblique angle
103 flap height
**104*a*** topmost point
**104*b*** topmost point
105 oblique angle
110 angle greater than 45 degrees
112 acute angle

DESCRIPTION OF THE PREFERRED EMBODIMENT

Referring now to the drawings, there is illustrated a preferred embodiment of the invention in a blank made of E-flute corrugated paperboard and, correspondingly, a carton created from the blank. It will be appreciated, as the description proceeds, that my invention may be realized in different embodiments and may be used in other applications.

Figure 2:
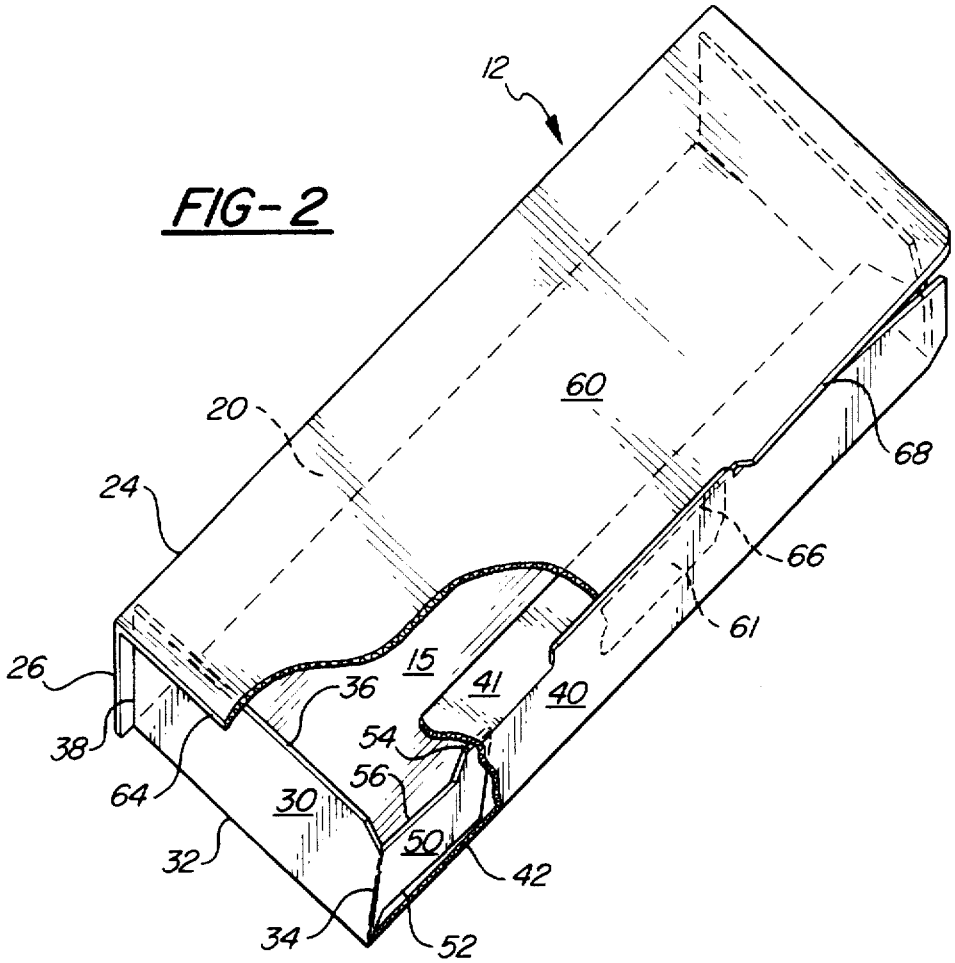
FIG. 2 is a perspective view of a carton formed from the blank of the preferred embodiment.

FIGS. 1 and 2 show blank 10 and box 12, respectively, of the preferred embodiment. The following discussion pertains to both the blank and box. All parts are labeled in the blank and select parts are labeled in the box. Because the embodiment is bilaterally symmetrical, only parts on one side of the blank may be labeled. However, it is understood that a corresponding part on the other side is referenced by a same numeral. Also, corresponding parts between drawings share the same reference numeral and alternate forms of a part carry the same numeral but with a different letter suffix.

The base of the carton is a bottom panel 15.

A rear wall 20 is hingedly attached to panel 15 at a rear wall fold line 22 (which also indicates the bottom edge of the wall) . Wall 20 has a top edge 24 and first and second free ends 26 and 27, respectively.

A pair of opposing parallel side walls 30 are hingedly attached to panel 15 at a pair of side wall fold lines 32 (which also indicates the bottom edge of each wall). Wall 30 has a front end 34, a free top edge 36, and a free rear end 38.

In the embodiment, end 38 is in alignment with rear wall fold line (or bottom edge) 22. However, it's possible to have end 38 slightly offset from alignment with fold line 32 by a small amount, such as one or two millimeters. This situation would be considered within the scope of the invention and end 38 would still be considered as being "in alignment" with fold line 22.

A front wall structure 49 comprises a front wall 40 and an auxiliary panel 41 that is hingedly attached to panel 40 at an auxiliary panel fold line 44. Wall 40 is hingedly attached to panel 15 at a front wall fold line 42 (which also indicates the bottom edge of the wall). Wall 40 has a top edge that is indicated by numeral 44 (the same numeral that indicates the auxiliary panel fold line) and has first and second ends 45 and 46, respectively. Part of structure 49 is a cover interlock means 47, which in the embodiment is a slot-forming slit disposed between wall 40 and panel 41. Other interlock means, such as a cut-out section in wall 40, are possible and would be considered to be within the scope of the invention.

An inward-slope-creating corner flap 50 is hingedly attached to the front end 34 of each side wall 30 at a corner flap fold line (so numeral 34 also indicates the corner flap fold line). In carton format, an "inward-slope-creating corner flap" is defined as a flap or panel that (a) is hingedly attached to an end of a first wall and (b) is in contact with an adjacent wall structure comprising a second wall and a panel hingedly attached to a top edge of that wall and (c) is disposed on the interior side of and parallel to the second wall and (d) due to the flap's configuration in conjunction with its contact with the adjacent wall structure, causes the first wall to slope inward at an acute angle at its end. This is illustrated in FIGS. 2, 3, 6, 8, and 10, and the acute angle is shown as angle 112 in FIG. 3. In the preferred embodiment, flap 50 has a bottom edge 52 that is non-collinear with fold line 32. It also has a top edge comprising an upper portion 54 and a lower portion 56. This structure is necessary to enable flap 50 to be inward-slope-creating (discussed further in a subsequent section).

A cover 69 comprises a cover panel 60 and a front wall structure interlock means 61. Panel 60 is hingedly attached to wall 20 at a cover fold line that is referenced by numeral 24 (the same numeral that indicates the top edge of wall 20). In the embodiment, interlock means 61 consists of a single flap; however, it could take other forms, such as multiple connected flaps, and such would be considered to be within the scope of the invention. Panel 60 has parallel first and second free side edges 64 and 65, respectively, and a front edge comprising a middle section 66 and first and second lateral sections 67 and 68, respectively. In the embodiment, interlock means 61 is hingedly attached to middle section 66.

To achieve matability, blank 10 has a recess 79 on each side of the blank which is created by the free side edge 64 (or 65), the free end 26 (or 27), and the free rear end 38.

Blank 10 has front and rear end edges 71 and 72, respectively, which represent furthermost extremities of the blank. A predetermined length 73 extends between the furthermost extremities. An imaginary midline 74 perpendicularly bisects length 73. In the embodiment shown in FIG. 1, midline 74 falls on fold line 22, so line 74 is not visible within the blank but can be seen extending from the sides.

In the embodiment, front end 34 and free rear end 38 of wall 30 are disposed on a same side of midline 74. (It is noted that it's possible for end 38 to be disposed exactly on midline 74, in which case end 38 would still be considered to be on the same side of midline 74 as end 34.) By having ends 34 and 38 on the same side of midline 74, it allows blank 10 to be mated with another blank 10 and have end edge 71 of one blank align with end edge 72 of the other blank; thereby allowing for maximum material savings. Alignment of adjacent blanks can be seen in FIG. 4.

Key Dimensions and Special Features

Proportional dimensions of certain structural elements are key to the invention and its operation. To minimize the outward angling problem inherent to E-flute side walls without rear flaps, while maximizing the load-carrying capacity, or volume, of the box cavity, the box has a short length and long width. Specifically, bottom panel 15 has a length 81 that extends between front and rear wall fold lines 22 and 42, respectively, and a width 82 that extends between side wall fold lines 32. In the embodiment, width 82 is substantially longer (more than 50 percent longer) than length 81. These proportional dimensions are important in that they make it possible to create a matable, alignable E-flute blank with free rear ends on the side walls and that forms into a workable food box having a box cavity with an acceptable load-carrying capacity. An "acceptable load-carrying capacity" is considered to be a box cavity with a volume exceeding 1200 cubic centimeters. One set of recommended dimensions for the embodiment when used as a pizzeria breadstick box is a width of 32 centimeters, a length of 13 centimeters, and a rear wall height of 4.75 centimeters.

Cover panel 60 and rear wall 20 also have a width 84 (that is indicated by a line positioned atop the blank in FIG. 1.) Width 84 is greater than width 82. In the closed box, this enables free ends 26 and 27 of wall 20 to extend beyond rear end 38 of side walls 30, and enables free side edges 64 and 65 of cover panel 60 to overlap top edge 36 of walls 30.

Side walls 30 have a height 85 that extends between top and bottom edges 32 and 36, respectively. Front wall 40 has a height 86 that extends between top and bottom edges 44 and 42, respectively. Auxiliary panel 41 has a height 87 that extends between edges 71 and 44. Height 87 is less than height 86. There is a bottom edge projection line 90 which is an imaginary line extending collinear from fold line (or bottom edge) 32. Corner flap 50 has a primary height 88 that is the distance between bottom edge 52 and lower top edge 56 and a secondary height 89 that is the distance between projection line 90 and upper top edge 54.

Figure 3:
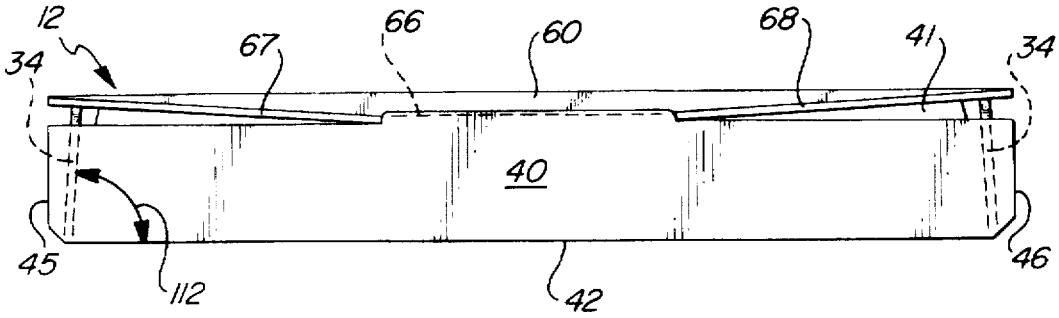
FIG. 3 is a front elevation view of the carton of the preferred embodiment.

Height 88 is less than height 86 (in part because edge 52 is non-collinear with fold line 32) and height 89 is greater than height 86. This structure causes front end 34 of side wall 30 to slope inward in the closed box (FIGS. 2 and 3). This occurs because a portion of panel 41 is disposed on top of flap 50 or, specifically, top edge 54, thereby pushing flap 50 downward and end 34 inward.

Front-Edge-Sloping Cover

Cover 69 is a "front-edge-sloping cover," which is defined as a cover that has a front edge that slopes upward from a middle section. As can be seen in FIG. 3, the front-edge-sloping cover is created as follows in the embodiment. Height 85 is greater than height 86. (Specifically, height 85 is approximately five millimeters higher than height 86 in the embodiment.) In the closed box, this structure causes middle section 66 of the front edge of cover panel 60 to lie lower than lateral sections 67 and 68 when the cover is interlocked with the front wall structure. In addition, it causes sections 67 and 68 to slope upward from section 66. The upward angle or slope of sections 67 and 68 has been slightly exaggerated in FIG. 3 to illustrate the concept. In actuality, the slope may be slightly less than shown.

Alternate Inward-Slope-Creating Corner Flaps

Figure 5:
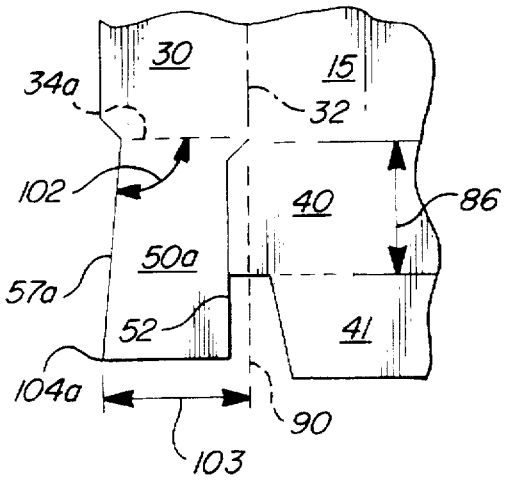
FIG. 5 is a plan view of a first alternate corner flap of the embodiment.
Figure 6:
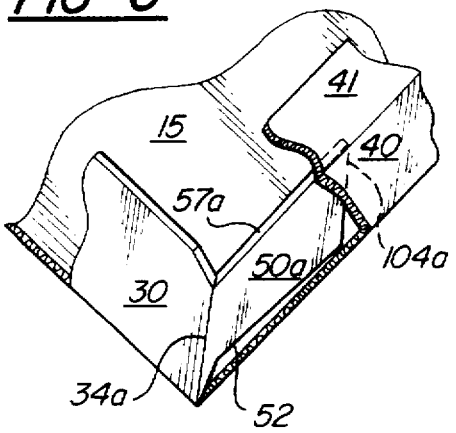
FIG. 6 is a perspective view of the first alternate flap in a corner section of a carton, the front wall structure being partially cut away.

FIGS. 5 and 6 show a first alternate corner flap 50*a*, which could replace flap 50 in the preferred embodiment. In FIG. 6 a partial section of front wall structure 49 is cut away to illustrate how flap 50*a* is disposed in relation to wall 40 and panel 41. In blank form (FIG. 5), flap 50*a* has a top edge 57*a* that angles upward from fold line 34*a* and is disposed at oblique angle 102 to fold line 34*a*. Flap 50*a* also has a height 103 that extends from bottom edge projection line 90 to a topmost point 104*a* on edge 57*a*. This structure, in conjunction with bottom edge 52 being non-collinear with fold line 32 and flap height 103 being greater than wall height 86, causes the front end (indicated by numeral 34*a*) of side wall 30 to slope inward in the closed box. This occurs because a portion of panel 41 is disposed on top of flap 50*a* as depicted in FIG. 6, thereby pushing flap 50*a* downward and end 34*a* inward.

Figure 7:
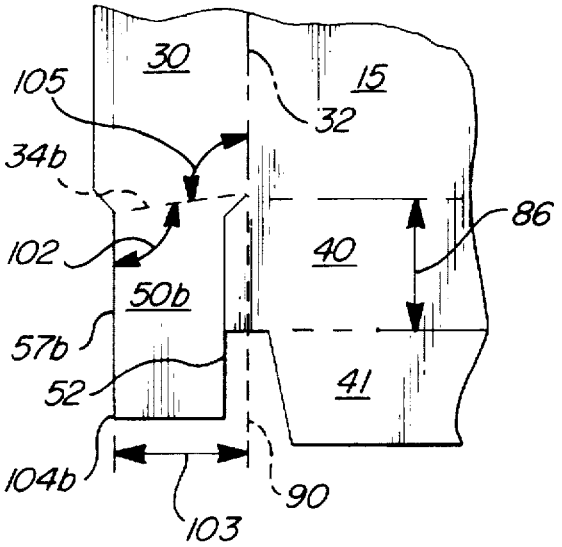
FIG. 7 is a plan view of a second alternate corner flap of the embodiment.
Figure 8:
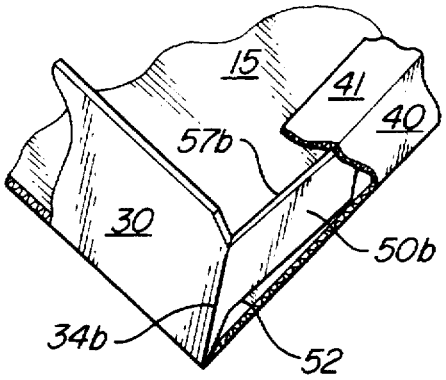
FIG. 8 is a perspective view of the second alternate flap in a corner section of a carton, the front wall structure being partially cut away.

FIGS. 7 and 8 show a second alternate corner flap 50*b* which could replace flap 50. In FIG. 8 a partial section of front wall structure 49 is cut away to illustrate how flap 50*b* is disposed in relation to wall 40 and panel 41. In the blank form (FIG. 7), flap 50*b* has a corner flap fold line 34*b* that angles forward from its intersection with fold line 32 and, therefore, is disposed at an oblique angle 105 to fold line (or bottom edge) 32. The flap also has oblique angle 102 between the corner flap fold line and top edge of the flap and a height 103 that extends from bottom edge projection line 90 to edge 57*b*. That height is approximately equal to height 86.

When flap 50*b* is folded perpendicular to wall 30, edge 57*b* angles upward from end 34*b* (caused by oblique angle 105). This makes the end of flap 50*b* the topmost point on edge 57*b*. This topmost point is indicated by numeral 104*b*. However, when the box is closed up and panel 41 is disposed on top of flap 50*b*, edge 57*b* is pushed downward to a position that is approximately parallel to bottom panel 15, thereby causing end 34*b* to slope inward. It is noted that front end 34*b* is also forward-angling. This causes front wall 40 to slope outward in the closed box. Therefore, when this second alternate corner flap is utilized, the box will have an outward-sloping front wall, which will necessitate a slightly longer cover panel on the box.

Figure 9:
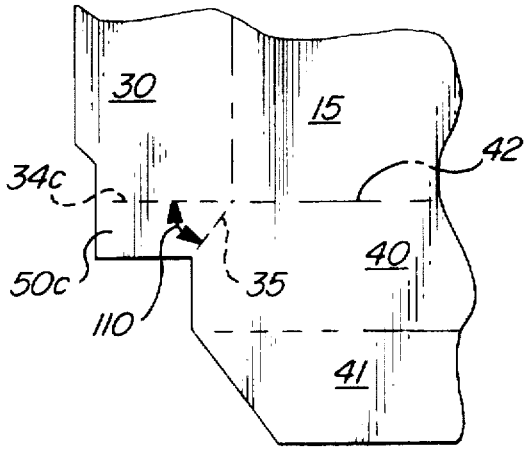
FIG. 9 is a plan view of a third alternate corner flap of the embodiment.
Figure 10:
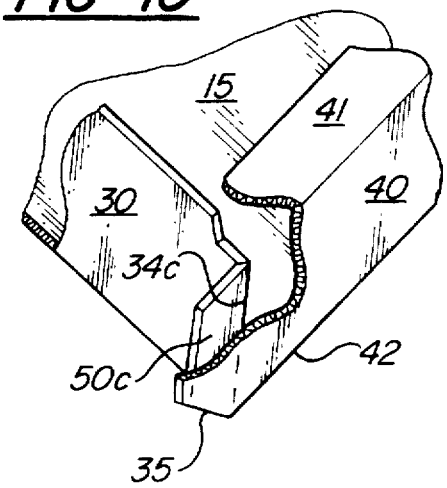
FIG. 10 is a perspective view of the third alternate flap in a corner section of a carton, the front wall structure being partially cut away.

FIGS. 9 and 10 show a third alternate corner flap 50*c* which could replace flap 50. In FIG. 10 a partial section of front wall structure 49 is cut away to illustrate how flap 50*c* is disposed in relation to wall 40. Flap 50*c* is hingedly attached to side wall 30 at corner flap fold line 34*c* and is also attached to front wall 40 at a secondary corner flap fold line 35. An angle 110 exists between fold lines 34*c* and 35 and that angle is greater than 45 degrees; or approximately 50 degrees in the embodiment. (It is also noted that the supplementary angle that exists between fold lines 35 and 42 would be less than 135 degrees.) This structure results in flap 50*c* being disposed perpendicular to wall 30 and parallel to wall 40 in the closed box and, as a result of angle 110 being greater than 45 degrees, causes the front end 34*c* of side wall 30 to slope inward (FIG. 10).

It is noted that all the corner flaps disclosed in my invention are inward-slope-creating flaps, meaning that each one meets the following criteria in the structure of a carton: (a) is hingedly attached to an end of a first wall and (b) is in contact with an adjacent wall structure comprising a second wall and a panel hingedly attached to a top edge of that wall and (c) is disposed on the interior side of and parallel to the second wall and (d) due to the flap's configuration in conjunction with its contact with the adjacent wall structure, causes the first wall to slope inward at an acute angle at its end.

Manufacture of Mating Blanks

Figure 4:
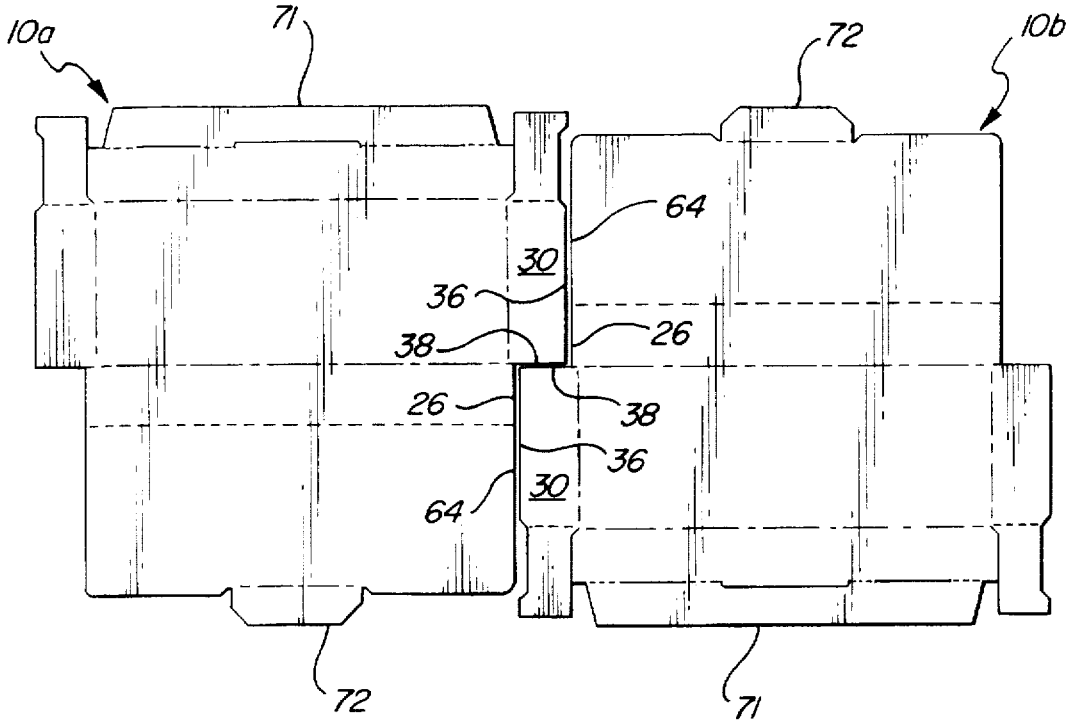
FIG. 4 is a plan view of multiple blanks of the preferred embodiment in mated configuration.

A key feature of the invention is that it can be manufactured in mated configuration, or with two or more blanks oriented at one hundred eighty degrees from each other, nested together, and with the end edges aligned. For brevity of definition, a blank having a structure that allows the blank to be manufactured in this configuration is called a "matable, alignable blank." When first and second units of blank 10 are mated, as shown in FIG. 4 with blanks 10*a* and 10*b*, it results in the corresponding side wall 30 of each blank being disposed within recess 79 (shown in FIG. 1) of the other blank, that recess being created by first free side edge 64, first free end 26, and free rear end 38. It is noted that end edge 71 of each blank is aligned with opposite end edge 72 of the adjacent blank.

For illustrative purposes, a small gap is shown between the blanks in FIG. 4. It is possible to manufacture the blanks with a gap between them and still be within the scope of the invention. However, it will be appreciated that in the blank-cutting process the blanks will likely be contiguous and, therefore, such gap will probably not exist. Finally, it may be expeditious to manufacture the blanks in connected pairs (for convenience in wrapping, handling and shipping) . To create a connected pair, a small bridge or connection point can be installed between first and second mated blanks. Prior to folding the blanks, the pair would be separated with a quick snap or pull. Probably the best location for this connection point between adjacent blanks would be at end 38.

Finally, it is noted that the position of the blanks can be reversed, whereupon the blanks would mate on sides opposite of those shown in FIG. 4. Naturally, this mirror-image variation is considered to be within the scope of the invention.

Set-up of the Box from the Blank

To set up box 12 from blank 10, the following procedure is recommended. It will be described as if one person were giving directions to another. It is noted that, because blank 10 has a minimum number of flaps, the procedure is quick and easy.

With panel 41 at the top and the outer surface of the blank facing you, grasp the blank by side walls 30 (one wall in each hand). With the thumbs, fold corner flaps 50 forward. Then fold walls 30 upright. Then, with the thumbs, fold front wall structure 49 forward and, with the index fingers, fold panel 41 downward and over the top edge of flaps 50. Finally, pull cover panel 60 upward and tuck flap 61 into slot 47.

The above procedure also applies to boxes incorporating the first and second alternate corner flaps. However, the third alternate corner flap requires a slightly different procedure, as follows. Grasping the blank by the side walls, fold walls 30 to upright position while simultaneously pushing front wall 40 to upright position with the thumbs. This causes the corners to form as shown in FIG. 10. Finally, close cover panel 60 onto the box and lock flap 61 into slot 47.

Fold Lines

Within the context of this invention, a fold line can be created by a number of means such as, for example, by a crease or score in the board, by a series of aligned spaced short slits in the board, and by a combination of aligned spaced short and long slits. In some cases, when a longer slit is bounded on the ends by a series of shorter slits or a score, the longer slit may be slightly offset in alignment from the shorter slits or score for the purpose of creating a slot along the fold line when the blank is set up into a box. Such an offset slit may be referred to herein as a "slot-forming slit." Nonetheless, the entire combination of long and short slits is considered to constitute a single fold line unless otherwise indicated. In addition, to create a fold line where one panel is folded 180° to lay parallel on another panel, the fold line may constitute two narrowly-spaced parallel scores or series of aligned slits. In this case, the two narrowly-spaced parallel scores or series of aligned slits constitute a single fold line unless otherwise indicated. In conclusion, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

CONCLUSION, RAMIFICATIONS, AND SCOPE

I have disclosed a type of foldable carton that can be manufactured in mated configuration with multiple blanks for maximum material savings. Structure of the invention includes: (a) a cover panel with free side edges, (b) a rear wall with free ends, (c) parallel side walls each with a free rear end and a free top edge, (d) inward-slope-creating corner flap on a front end of each side wall to counteract the side walls sloping outward, (e) a front-edge-sloping cover to counteract the free side edges of the cover warping upward, and (f) a shortened box length and elongated box width (relative to one another) to provide a matable E-flute carton of the above structure with a workable shape and acceptable load-carrying capacity for a food product.

The advantages of my invention are a cost-effective, matable rectangular-shaped carton which can be made of E-flute board and which, nonetheless, maintains acceptable load-carrying capacity and functionality during use.

The illustrated number, size, shape, type, and placement of components represent the preferred embodiment; however, many other combinations and configurations are possible within the scope of the invention.

In conclusion, it is understood that my invention is not to be limited to the disclosed embodiments but, on the contrary, is intended to cover various modifications and equivalent arrangements included within the spirit and scope of the appended claims.

I claim:

1. A blank of foldable material cut and scored to define:

(a) a bottom panel;

(b) a rear wall hingedly attached to said bottom panel at a rear wall fold line, said rear wall having first and second free ends;

(c) a cover hingedly attached to a top edge of said rear wall at a cover fold line and comprising:

(i) a cover panel having parallel first and second free side edges, (ii) a front wall structure interlock means;

(d) first and second side walls hingedly attached to said bottom panel at parallel first and second side wall fold lines, respectively, each of the side walls having a front end, a free rear end adjacent said rear wall, and a free top edge;

(e) a front wall structure comprising a front wall hingedly attached to said bottom panel at a front wall fold line, said front wall structure incorporating a cover interlock means, whereby after said blank has been erected into a carton said cover interlock means connects with said front wall structure interlock means.

2. The blank of claim 1 wherein:

said rear wall has a rear wall width which is defined as the distance between said first and second free ends, said cover panel has a cover panel width which is defined as the distance between said first and second free side edges, said bottom panel has a bottom panel width which is defined as the distance between said first and second side wall fold lines, said bottom panel width is less than said rear wall width and less than said cover panel width.

3. The blank of claim 1 wherein:

a recess is created by the first free side edge of the cover panel, the first free end of the rear wall, and the free rear end of the first side wall, said blank has opposite front and rear end edges formed by furthermost extremities of the blank and a predetermined length extending between said furthermost extremities, said blank has an imaginary midline perpendicularly bisecting said predetermined length, both the front end and the free rear end of each of the first and second side walls are disposed on a same side of said imaginary midline, whereby said blank can be oriented in mated relationship with another blank of same structure as said blank and the opposite end edges of the blanks will align and a portion of the first side wall of one of the blanks will fit within the recess of the other blank.

4. The blank of claim 1 wherein:

said front wall has a front wall height which is defined as the distance between top and bottom edges of said front wall, said front wall structure further comprises an auxiliary panel hingedly attached to the top edge of said front wall, said auxiliary panel having top and bottom edges and an auxiliary panel height which is defined as the distance between the top and bottom edges of said auxiliary panel, said auxiliary panel height is less than said front wall height.

5. The blank of claim 1 wherein:

said front wall has a front wall height which is defined as the distance between top and bottom edges of said front wall, one of the first and second side walls has a side wall height which is defined as the distance between top and bottom edges of said side wall, said front wall height is less than said side wall height by a predetermined distance;

whereby after said blank has been erected into a carton and said cover panel has been closed and interlocked with said front wall structure, a middle section of a front edge of said cover panel is disposed lower than lateral sections of said front edge.

6. The blank of claim 5 wherein:

said predetermined distance is greater than three millimeters.

7. The blank of claim 1 further comprising:

an auxiliary panel hingedly attached to a top edge of said front wall, an inward-slope-creating corner flap hingedly attached to the front end of said first side wall, whereby after said blank has been erected into a carton said first side wall tends to slope inward at the front end.

8. The blank of claim 7 wherein:

said inward-slope-creating corner flap has top and bottom edges and a major portion of said bottom edge is disposed non-collinear to said first side wall fold line.

9. The blank of claim 8 wherein:

said first side wall has a bottom edge projection line which is defined as an imaginary line disposed collinear with the first side wall fold line, the top edge of said inward-slope-creating corner flap has upper and lower portions, said inward-slope-creating corner flap has a primary height which is defined as the distance between its bottom edge and the lower portion of the top edge and a secondary height which is defined as the distance between the bottom edge projection line and the upper portion of the top edge, said front wall has a height which is defined as the distance between top and bottom edges of the wall;

wherein:

the primary height of the corner flap is less than the height of said front wall and the secondary height of the corner flap is greater than the height of said front wall, whereby after said blank has been erected into a carton said auxiliary panel overlaps an entire portion of the corner flap and holds it down, causing first side wall to tend to slope inward at the front end.

10. The blank of claim 8 wherein:

the top edge of said inward-slope-creating corner flap is disposed at an oblique angle to said corner flap fold line, whereby after said blank has been erected into a carton said auxiliary panel overlaps the corner flap and holds it down, causing the first side wall to tend to slope inward at the front end.

11. The blank of claim 10 wherein:

said corner flap fold line is disposed at an oblique angle to said first side wall fold line.

12. The blank of claim 8 wherein:

said inward-slope-creating corner flap is hingedly attached to an end of said front wall at a secondary corner flap fold line, said secondary corner flap fold line is disposed at an angle to said corner flap fold line and said angle is greater than 45 degrees, whereby after said blank has been erected into a carton said first side wall is caused to tend to slope inward at the front end.

13. The blank of claim 1 wherein:

said foldable material is E-flute corrugated paperboard, said bottom panel has a length which is defined as the distance between the front and rear wall fold lines and a width which is defined as the distance between the first and second side wall fold lines, said width is at least fifty percent longer than said length, whereby after said blank has been erected into an E-flute box, the box functions acceptably well and also has an acceptable load-carrying capacity.

14. First and second blanks formed from a single sheet of foldable material, each of said blanks being cut and scored to define:

(a) opposite front and rear end edges formed by furthermost extremities of the respective blank;

(b) a bottom panel;

(c) a rear wall hingedly attached to said bottom panel at a rear wall fold line, said rear wall having first and second free ends;

(d) a cover hingedly attached to a top edge of said rear wall at a cover fold line and comprising:

(i) a cover panel having parallel first and second free side edges, (ii) a front wall structure interlock means;

(e) first and second side walls hingedly attached to said bottom panel at parallel first and second side wall fold lines, respectively, each of the side walls having a front end, a free rear end adjacent said rear wall, and a free top edge;

(f) a front wall structure comprising a front wall hingedly attached to said bottom panel at a front wall fold line, said front wall structure incorporating a cover interlock means, whereby after said blank has been erected into a carton said cover interlock means connects with said front wall structure interlock means;

wherein the blanks are oriented in mated relationship with the opposite end edges of each blank aligned with the opposite end edges of the other blank and with the first side wall of each blank disposed within a recess created by the first free side edge of the cover, the first free end of the rear wall, and the free rear end of the first side wall of the other blank.

15. The first and second blanks defined in claim 14, wherein in each of the blanks:

said rear wall has a rear wall width which is defined as the distance between said first and second free ends, said cover panel has a cover panel width which is defined as the distance between said first and second free side edges, said bottom panel has a bottom panel width which is defined as the distance between said first and second side wall fold lines, said bottom panel width is less than said rear wall width and less than said cover panel width.

16. The first and second blanks defined in claim 14, wherein in each of the blanks:

said front wall has a front wall height which is defined as the distance between top and bottom edges of said front wall, said front wall structure further comprises an auxiliary panel hingedly attached to the top edge of said front wall, said auxiliary panel having top and bottom edges and an auxiliary panel height which is defined as the distance between the top and bottom edges of said auxiliary panel, said auxiliary panel height is less than said front wall height.

17. The first and second blanks defined in claim 14, wherein each of the blanks further comprises:

an auxiliary panel hingedly attached to a top edge of said front wall, a first inward-slope-creating corner flap hingedly attached to the front end of said first side wall, whereby after each of said blanks has been erected into a carton said first side wall tends to slope inward at the front end.

18. A box of foldable material, said box comprising:

(a) a bottom panel;

(b) a plurality of walls and wall structures including:

(i) a rear wall, (ii) a front wall structure comprising a front wall, (iii) first and second side walls;

(c) a cover comprising:

(i) a cover panel hingedly attached to a top edge of said rear wall, (ii) a front wall structure interlock means, said means being interlocked with said front wall structure;

wherein said cover is a front-edge-sloping cover.

19. The box of claim 18 wherein:

each of said rear wall, front wall, and first and second side walls has a predetermined height, the predetermined height of each of said first and second side walls being greater than the predetermined height of said front wall by a predetermined distance;

said cover panel overlaps said first and second side walls and has a front edge comprising a plurality of sections including a middle section and first and second lateral sections, said front wall structure interlock means comprises a flap hingedly attached to said middle section;

whereby the first and second lateral sections of the front edge of said cover panel slope upward from the middle section.

20. The box of claim 19 wherein:

said predetermined distance is greater than three millimeters.

21. A box of foldable material, said box comprising:

(a) a bottom panel;

(b) a first wall having an end and a bottom edge;

(c) a structure adjacent said first wall, said structure comprising a second wall and a panel hingedly attached to a top edge of said second wall;

(d) an inward-slope-creating corner flap hingedly attached to the end of said first wall at a corner flap fold line and disposed interior and parallel to said second wall and in contact with at least one of the second wall and the panel, whereby the contact of the corner flap with said at least one of the second wall and the panel causes said first wall to slope inward at said end;

wherein the end of said first wall is disposed at an acute angle to said bottom panel.

22. The box of claim 21 wherein:

a top edge of said inward-slope-creating corner flap has upper and lower portions.

23. The box of claim 21 wherein:

a top edge of said inward-slope-creating corner flap is disposed at an oblique angle to said corner flap fold line.

24. The box of claim 21 wherein:

said corner flap fold line is disposed at an oblique angle to the bottom edge of said first wall.

25. The box of claim 21 wherein:

said inward-slope-creating corner flap is hingedly attached to said second wall at a secondary corner flap fold line, said secondary corner flap fold line is disposed at an angle to said corner flap fold line and said angle is greater than 45 degrees.

* * * * *